US009068376B2

(12) United States Patent
Mitchell et al.

(10) Patent No.: US 9,068,376 B2
(45) Date of Patent: Jun. 30, 2015

(54) STRIKE FOR WALK-IN COLD ROOMS

(71) Applicant: Kason Industries, Inc., Newnan, GA (US)

(72) Inventors: Brett A Mitchell, Newnan, GA (US); Thomas A Thorsen, Wedowee, AL (US)

(73) Assignee: Kason Industries, Inc., Newnan, GA (US)

( * ) Notice: Subject to any disclaimer, the term of this patent is extended or adjusted under 35 U.S.C. 154(b) by 65 days.

(21) Appl. No.: 13/867,873

(22) Filed: Apr. 22, 2013

(65) Prior Publication Data

US 2014/0312631 A1 Oct. 23, 2014

(51) Int. Cl.
*E05B 3/00* (2006.01)
*E05B 65/00* (2006.01)
*E05B 1/00* (2006.01)

(52) U.S. Cl.
CPC ..... *E05B 65/0042* (2013.01); *E05B 1/003* (2013.01)

(58) Field of Classification Search
CPC ..... E05B 65/0042; E05B 65/0053; E05B 63/0056; E05B 15/0245; E05B 63/006; E05B 63/246
USPC ..... 292/92, 347, 348, DIG. 71, DIG. 65
See application file for complete search history.

(56) References Cited

U.S. PATENT DOCUMENTS 1,260,469 A 3/1918 Smith
1,916,848 A 7/1933 North
2,001,740 A 5/1935 McPherson
2,074,979 A 3/1937 Brantingson
2,153,819 A 4/1939 Voorhees
2,193,488 A 3/1940 Morley et al.
2,198,079 A 4/1940 Ferris et al.
2,265,961 A 12/1941 Ziebolz (Continued)

FOREIGN PATENT DOCUMENTS

DE 1915618 10/1970
FR 1528245 4/1968

(Continued)

OTHER PUBLICATIONS

Kason Catalog 6, p. 106, Kason 4001 locking handle.

(Continued)

*Primary Examiner* — Kristina Fulton
*Assistant Examiner* — Christine M Mills
(74) *Attorney, Agent, or Firm* — Baker Doneslon; Dorian B. Kennedy

(57) ABSTRACT

A lockable strike (10) is disclosed which includes an exterior strike assembly (16) and an interior release assembly (17). The exterior strike assembly has a housing (25) and a rod receiver (30) with a slotted rod holder (32). The interior release assembly includes a pinned coupling rod (35), a lever (46), and a space adjuster (47). The pinned coupling rod is received within rod holder. The space adjuster includes an adjustment base (56) and a hub body (57). The adjustment base has a floor (63) with three stepped camming surfaces (65). The nub body also a floor (75) with three stepped camming surfaces (77) which are configured to ride upon the adjustment base camming surfaces. To adjust for varying thicknesses of a wall, the space adjuster is expanded in size by rotating the nub body relative to the adjustment base so that the camming surfaces more these components apart.

10 Claims, 5 Drawing Sheets

(56) References Cited

U.S. PATENT DOCUMENTS

| | | | | | |
|---|---|---|---|---|---|
| 2,461,426 | A | * | 2/1949 | King | 292/340 |
| 2,533,396 | A | * | 12/1950 | Payne | 292/340 |
| 2,636,767 | A | * | 4/1953 | Groeger | 292/341.18 |
| 2,743,953 | A | * | 5/1956 | Marra et al. | 292/340 |
| 2,872,233 | A | | 2/1959 | Bordner, Jr. | |
| 3,214,809 | A | * | 11/1965 | Zahnor | 24/68 B |
| 3,456,557 | A | | 7/1969 | Hautau | |
| 3,599,453 | A | | 8/1971 | Bauernfeind | |
| 3,652,113 | A | | 3/1972 | Odend'hal et al. | |
| 3,678,716 | A | | 7/1972 | Cobb | |
| 3,744,283 | A | | 7/1973 | Schmidt | |
| 3,843,173 | A | | 10/1974 | Harrell | |
| 4,099,754 | A | | 7/1978 | Hoebing | |
| 4,203,622 | A | | 5/1980 | Cook et al. | |
| 4,229,956 | A | | 10/1980 | Thorburn | |
| 4,280,725 | A | | 7/1981 | Berkowitz et al. | |
| 4,341,408 | A | | 7/1982 | Blevins | |
| 4,475,364 | A | | 10/1984 | Frank | |
| 4,484,462 | A | | 11/1984 | Berkowitz | |
| 4,530,532 | A | * | 7/1985 | Fujiya | 292/341.15 |
| 4,553,415 | A | | 11/1985 | Maffey | |
| 4,565,079 | A | | 1/1986 | Smith | |
| 4,565,080 | A | | 1/1986 | Kincaid et al. | |
| 4,613,176 | A | | 9/1986 | Kelly | |
| 4,635,977 | A | | 1/1987 | Yamada | |
| 4,669,282 | A | | 6/1987 | Hoyt et al. | |
| 4,697,444 | A | | 10/1987 | Maffey | |
| 4,704,882 | A | | 11/1987 | Takasaki | |
| 4,782,675 | A | | 11/1988 | Thorburn | |
| 4,884,421 | A | | 12/1989 | Lindsay | |
| 4,911,486 | A | | 3/1990 | Anderson | |
| 4,991,414 | A | | 2/1991 | Moore et al. | |
| 5,000,494 | A | | 3/1991 | Guibleo | |
| 5,152,564 | A | | 10/1992 | Martineau | |
| 5,456,505 | A | | 10/1995 | Yamada | |
| 5,490,697 | A | | 2/1996 | Surko, Jr. | |
| 5,582,443 | A | | 12/1996 | Finkelstein et al. | |
| 5,634,357 | A | | 6/1997 | Nutter et al. | |
| 6,112,471 | A | | 9/2000 | Welch et al. | |
| 6,178,789 | B1 | | 1/2001 | Finkelstein et al. | |
| 6,354,119 | B1 | | 3/2002 | Molzer | |
| 6,526,788 | B2 | | 3/2003 | Finkelstein et al. | |
| 6,877,346 | B1 | | 4/2005 | Finkelstein | |
| 6,923,029 | B2 | | 8/2005 | Waschgler | |
| 6,952,940 | B2 | | 10/2005 | Molzer et al. | |
| 2007/0119220 | A1 | | 5/2007 | Maquet | |

FOREIGN PATENT DOCUMENTS

| | | |
|---|---|---|
| GB | 2040344 | 8/1980 |
| GB | 2172331 | 9/1986 |
| GB | 2219035 | 11/1989 |
| GB | 2263304 | 7/1993 |
| WO | 90-06412 | 6/1990 |

OTHER PUBLICATIONS

Kason Catalog 6, p. 110, Kason 4168 locking handle.
Illinois Locks Catalog, p. 19, Illinois Lock D6714 locking cylinder.
Illinois Locks Catalog, p. 19, Illinois Lock D8714 locking cylinder.
Chicago Lock Co. Catalog, 3-7, Chicago 180-4255 Handle cylinder.

* cited by examiner

STRIKE FOR WALK-IN COLD ROOMS

TECHNICAL FIELD

This invention relates to lock strikes, and specifically to a lock strike for walk-in cold rooms.

BACKGROUND OF INVENTION

Walk-in cold rooms, such as walk-in coolers, freezers, or other refrigerated environments, are common in various industries, including supermarkets and grocery stores, commercial kitchens, and other food service facilities. They typically nave one or more access doors for entry and exit from the environment. Since these environments are often used to store valuable contents, such as expensive products and/or large quantities of products, it is typically desirable that the access door(s) can be locked to control and/or restrict access to such contents. For example, to control access, the availability of a keyed locking option may be desirable so that keys can be provided to personnel who are authorized to access the cold-room environment. As another example, to restrict access during certain times, the availability of an alternate or additional locking option may be desirable so that even authorized personnel cannot access the cold-room environment. There may also be other reasons to control and/or restrict access to walk-in cold rooms such as safety or maintenance.

A problem associated with the locking of a cold-room door is the possibility that a person may become locked within the cold-room. To resolve this potential problem lock strikes have been designed to be mounted to the wall by a fastener extending through the cold-room wall having a threaded rod threaded into the strike and a knob accessible to one on the inside of the cold-room. The unthreading of the fastener from the strike causes the strike to fall off the wall and be disengaged from the locking mechanism. A problem with this type of device is that if one overly tightens the fastener it may become difficult for the person trapped within the cold-room to turn and release it from the strike. Also, a person unfamiliar with the product may not realize that turning the internal knob releases the strike and allows egress from the cold-room. Lastly, this type of fastener does not allow for variations in the thickness of the cold-room wall.

Accordingly, it is seen that a need exists for a lockable strike for walk-in cold rooms that is strong yet allows easy release from the wall and adjustability for varying wall thicknesses. It is to the provision of such therefore that exemplary embodiments of the present invention are primarily directed.

SUMMARY OF INVENTION

A lockable strike for walk-in cola rooms having a locking handle with a moveable bolt comprises an exterior strike assembly having a housing configured to receive the bolt of a locking handle, and a rod receiver coupled to the housing. The lockable strike also has an interior strike assembly having a rod having a first end configured to rotatably mate with the rod receiver, a handle coupled to a second end of the rod, and a space adjuster coupled to the rod between the first and second ends. The space adjuster includes an adjustment base with at least one camming surface inclining in a rotary direction about an adjustment base central rod passageway. The space adjuster also includes a hub body with at least one camming surface inclining in a rotary direction about a hub body central rod passageway. The adjustment base camming surface and the hub body camming surface are configured to mate so as to expand and contract the size of the space adjuster in a longitudinal direction along the rod through rotary movement of the hub body relative to the adjustment base.

DETAILED DESCRIPTION

Figure 1:
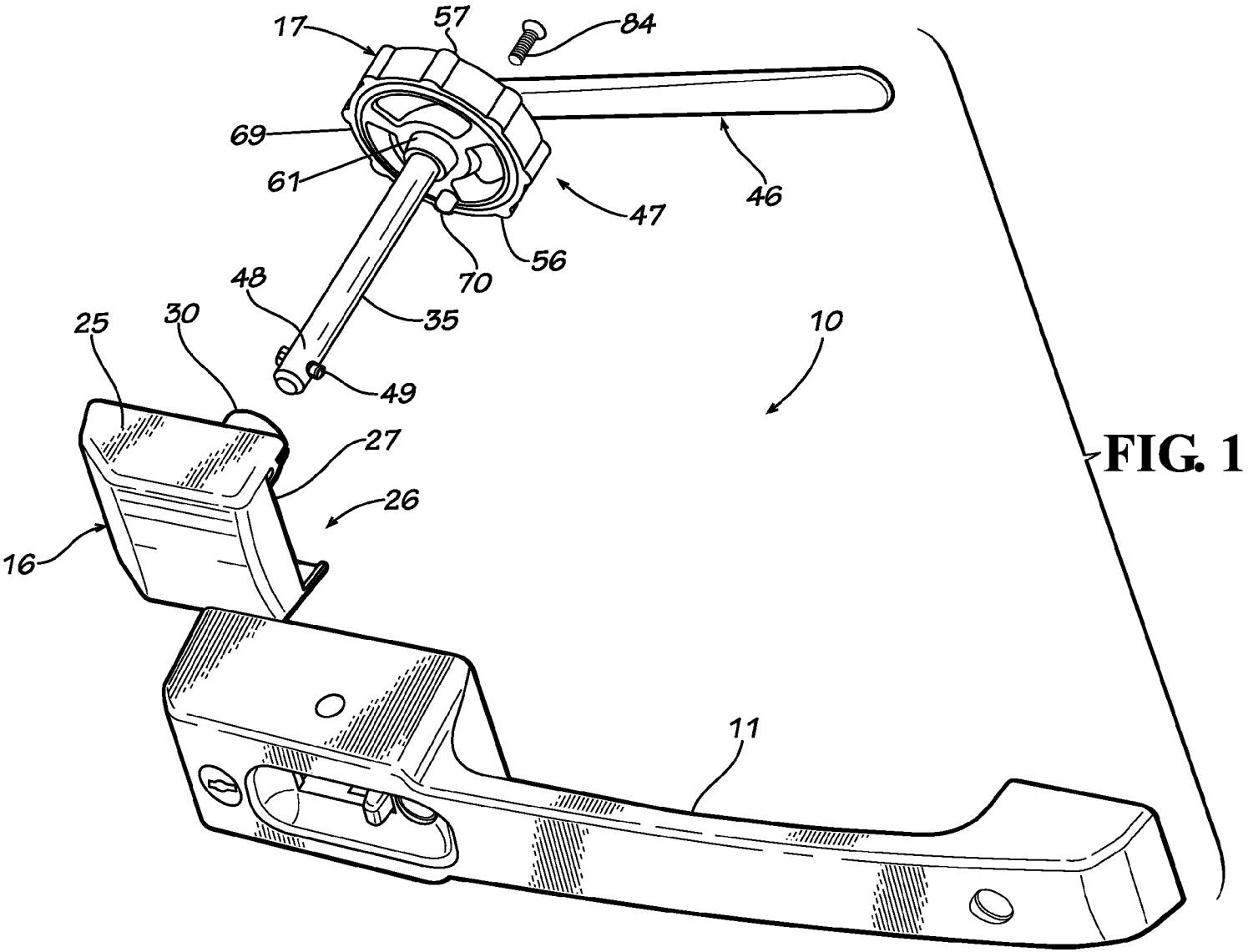
FIG. 1 is a perspective, exploded view of a lockable strike for walk-in cold rooms.
Figure 2:
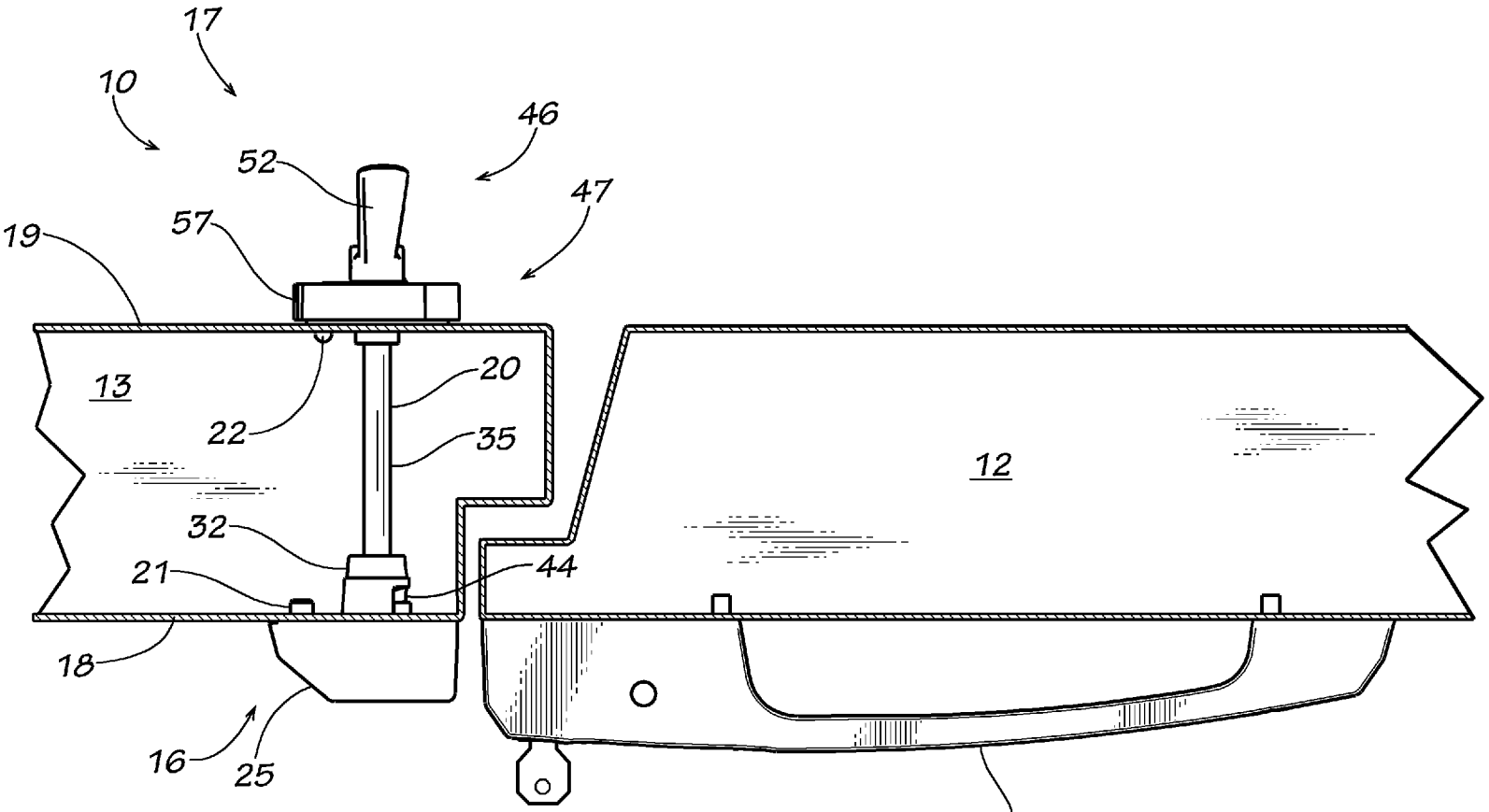
FIG. 2 is a partial cross-sectional side view of the lockable strike for walk-in cold rooms shown in FIG. 1 and shown mounted to a wall and door.
Figure 3:
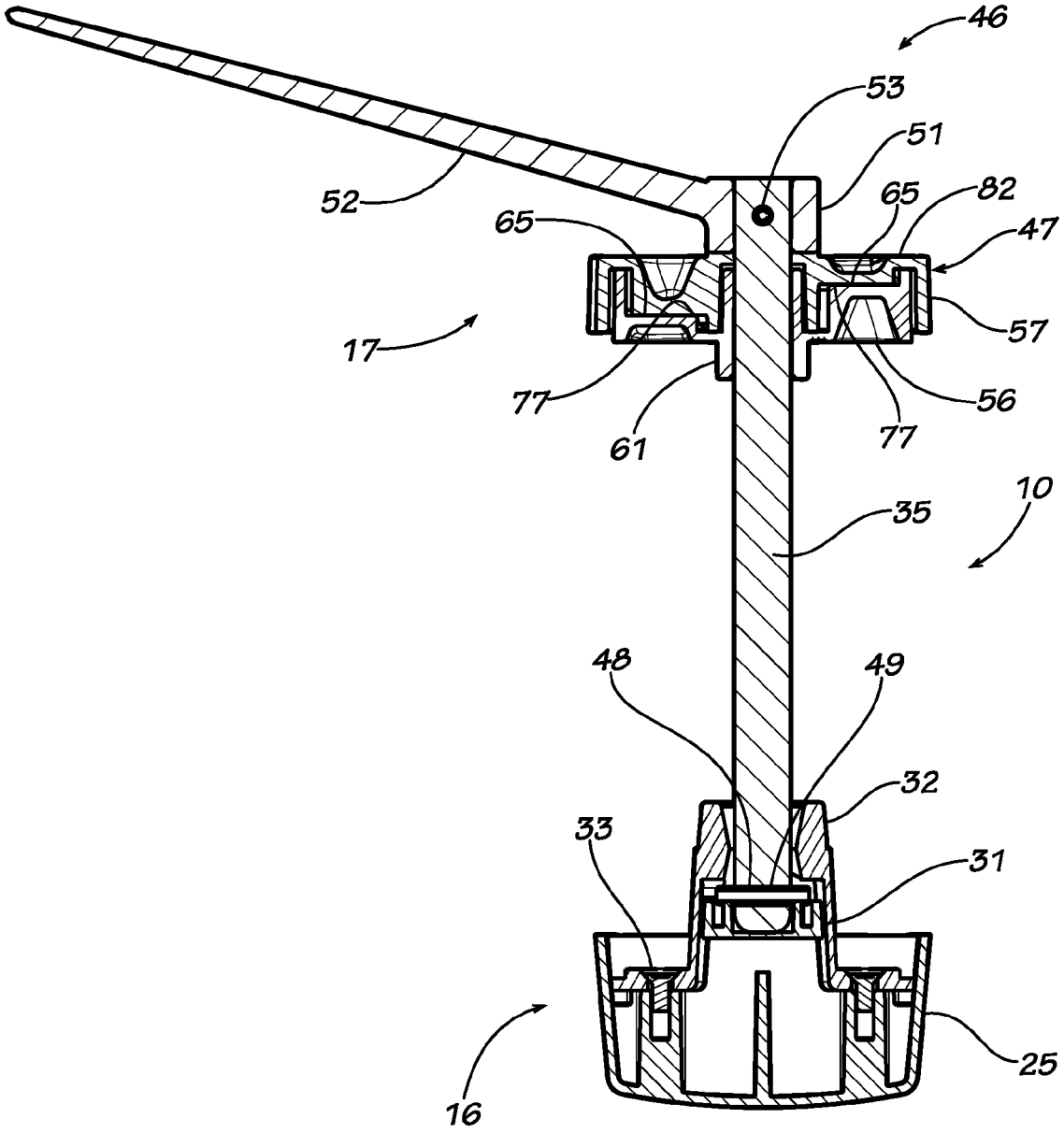
FIG. 3 is a cross-sectional side view of the lockable strike for walk-in cold rooms shown in FIG. 1.
Figure 4:
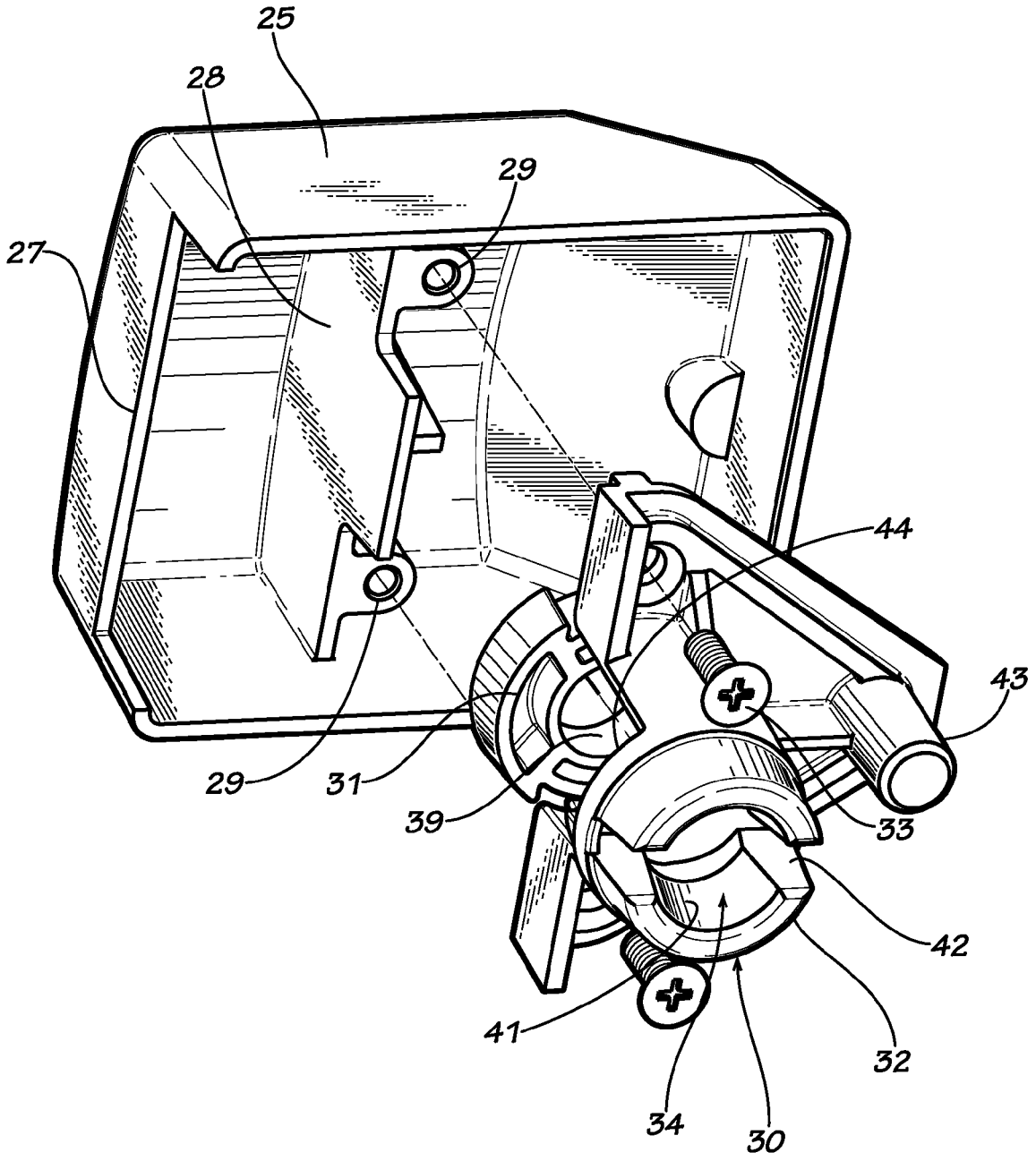
FIG. 4 is a perspective view of a portion of the lockable strike for walk-in cold rooms shown in FIG. 1.
Figure 5:
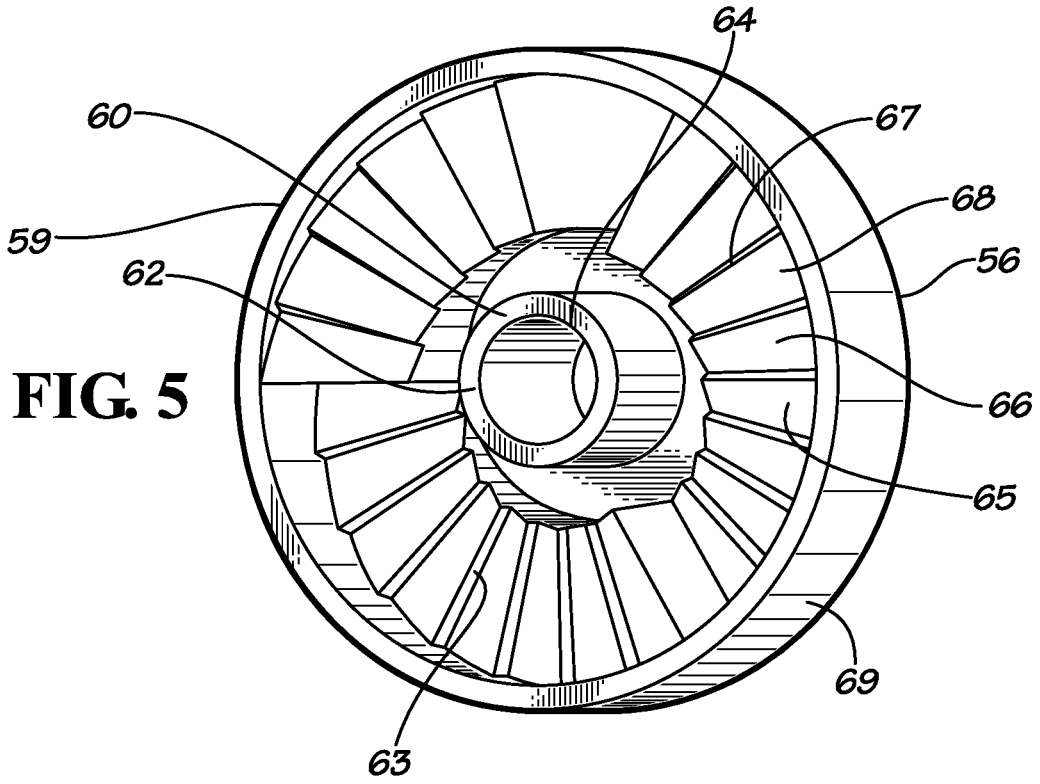
FIG. 5 is a perspective view of an adjustment base portion of the lockable strike for walk-in cold rooms shown in FIG. 1.
Figure 6:
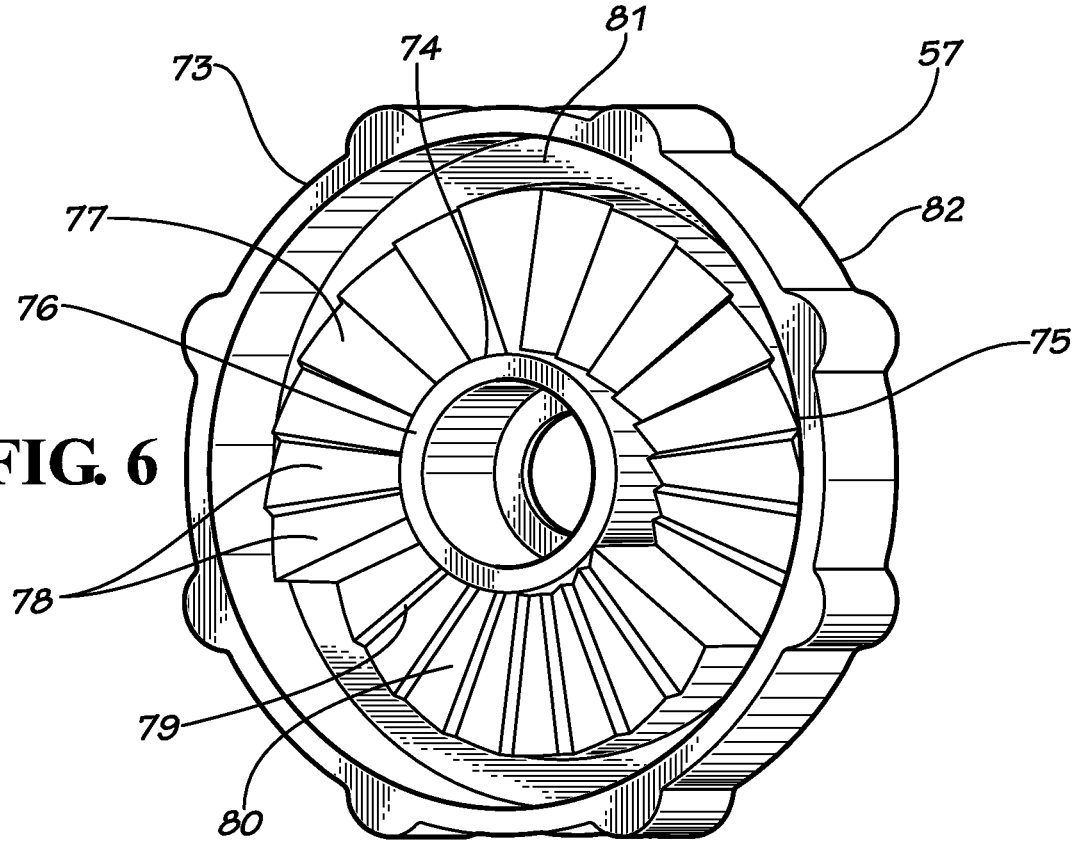
FIG. 6 is a perspective view of a hub body portion of the lockable strike for walk-in cold rooms shown in FIG. 1.

With reference to the drawings, there is shown a lockable strike 10 for walk-in cold rooms according to the present invention. The lockable strike 10 is used in conjunction with a locking handle 11 attached to a door 12 of a walk-in cold room within a surrounding wall 13 to control and/or restrict opening of the door 12 and access the walk-in cold room. The lockable strike 10 includes an exterior strike assembly 16 and an interior release assembly 17. The exterior strike assembly 16 is configured to be mounted to the exterior surface 18 of the cold room wall 13 adjacent the door. The interior release assembly 17 is designed to be mounted to the interior surface 19 of the cold room wall 13 adjacent the door. The cold room wall 13 has a strike rod through hole or passageway 20 therethrough. The exterior surface 18 of the wall has a detent hole 21 therein which extends approximately ½ inch into the wall. Similarly, the interior surface 19 of the wall has a detent hole 22 therein which extends approximately ½ inch into the wall.

The exterior strike assembly 16 includes a metal cover or housing 25 having a bolt opening 26 therein partially defined by a bolt opening top edge 27. The housing 25 also has an interior mounting wall 28 with two screw mounting holes 29 therein. The exterior strike assembly 16 also includes a rod receiver 30 comprised of a plug 31 and a slotted rod holder 32 coupled to the interior mounting wall 23 through two mounting screws 33 extending through the rod holder 32 and into mounting screw holes 29. The plug 31 exterior shape is configured to be keyed into slotted rod holder 32 to prevent rotational movement from occurring. The rod holder 32 has a central passage 34 configured to receive and releaseably hold a pinned coupling rod 35, described in more detail hereinafter, therein while the plug 31 has a central recess or hole 39 therein coaxially aligned with the central passage 34 and configured to receive the end of a coupling rod 35. The rod holder central passage 34 has a generally circular central portion 41 and two oppositely disposed pin portion 42 extending outwardly from the central portion 41. The pin portions 42 extend to two laterally and rotationally offset pin seating slots 44. Lastly, the rod receiver 30 includes a projection or detent 43 which is configured to be received within exterior wall detent hole 21 to prevent rotation or movement of the strike assembly 16 relative to the wall 13. The rod receiver 30 may be made of a metal material.

The interior release assembly 17 includes the previously identified pinned coupling rod 35, a handle or lever 46 coupled to the end of the pinned coupling rod 35 opposite from the strike assembly 16, and a space adjuster 47 couple to the pinned coupling rod adjacent to and abutting the level 46. The pinned coupling rod 35 is cylindrical with a through hole 48 having a metal guide pin 49 therein adjacent the rod end which is received within the strike assembly and extending outwardly from opposite sides of the rod. The coupling rod 35 may be made of a metal material such as brass, while the space adjuster 47 may be made of a plastic material such as polypropylene.

The lever 46 has a hub 51 and hand grip 52 extending from the hub 51. The lever 52 is mounted to the end of the pinned coupling rod 35 and may be secured thereto to prevent relative rotation therebetween with a set screw or a pin 53 extending through the hub 51 and pinned coupling rod 35.

The space adjuster 47 includes an adjustment base 56 which is positioned against the interior surface 19 of the wall 13 and a hub body 57 which is configured to receive the adjustment base 56, i.e., the adjustment base is nested within the hub body. The adjustment base 56 has a cylindrical outer sidewall 59, a concentrically positioned cylindrical inner sidewall 60 having an exterior boss 61 and an interior boss 62, and a floor 63 extending between the outer sidewall 59 and the inner sidewall 60. The inner sidewall 60 and bosses 61 and 62 defines a rod passageway 64 therethrough in which the pinned coupling rod 35 is moveably positioned for rotational and longitudinal movement. The floor 63 has three radially spaced, arcuate, internal, stepped camming ramps or surfaces 65. The camming surfaces 65 incline in the counter-clockwise direction when viewed from a position facing the camming surfaces 65. The camming surfaces 65 have a series of steps 66, each step having a ledge 67 and a step top surface 68. The exterior facing surface 69 of the adjustment base floor 63 includes a detent, projection or bump 70 which is configured to fit within the cold room wall interior surface detent hole 21 to prevent relative rotation therebetween.

The hub body 57 also has a cylindrical outer sidewall 73, a concentrically positioned cylindrical inner sidewall 74, and a floor 75 extending between the outer sidewall 73 and the inner sidewall 75. The inner sidewall 75 defines a rod passageway 76 therethrough in which the pinned coupling rod 35 is moveably positioned for rotational and longitudinal movement. The floor 75 has three radially spaced, arcuate, internal, stepped camming ramps or surfaces 77 which are configured to ride upon and mesh with the adjustment base camming surfaces 65. The camming surfaces 77 incline in the counter-clockwise direction when viewed from a position facing the camming surfaces 77. The camming surfaces 77 have a series of steps 78, each step having a ledge 79 and a step top surface 80. An annular recess 81 is formed between the camming surfaces 77 and the outer sidewall 73 which is configured to receive am edge portion of the outer sidewall 59 of the adjustment base 47 nested within the hub body 57. The exterior facing surface 82 of the hub body floor 75 has three depressions or drill points in the thickest portions of the floor. The hub body 57 may be fixedly coupled to the adjustment base through a mounting screw 84 once its final position is determined.

In use, exterior strike assembly 16 is positioned against the exterior surface 18 of the cold-room wall 13 with the rod holder 32 passing into the wall strike rod through hole 20 and the detent 43 extending into the exterior surface detent hole 21. With the exterior strike assembly 16 held in place against the wall the interior strike assembly 17 is positioned against the wall interior surface 19 with the pinned coupling rod 35 extending through the strike rod through hole 20 and into the rod holder central passageway 34 and the adjustment base detent 70 extending into the wall interior surface dent hole 22. The pinned coupling rod 35 is passed into the rod holder with guide pin 43 passing through the pin portions 42 of the central passageway 34, which also is the "release" position of the handle in case of emergency. The lever is then rotated clockwise 90 degrees to a "locked" position wherein the guide pin 49 are no longer aligned with the central passageway pin portions 42, but instead are now residing within the pin seating slots 44. The seating of the pins within the slots 44 releaseably retains the rod 35 within the rod holder 32 through pressure therebetween.

To adjust for varying thicknesses of the wall 13 the space adjuster 47 is expanded in size to provide a tight fit against the wall interior surface 19 and the lever hub 51 for a solid mounting of the lockable strike 10 against the wall 13. This task is accomplished by first rotating the lever back approximately 45 degrees (counter-clockwise) and then rotating the hub body 57 counter-clockwise with respect to the underlying adjustment base 56. This movement of the hub body 57 causes the hub body camming surfaces 77 to ride and rise upon the underlying adjustment base camming surfaces 65, thereby expanding the width or thickness of the space adjuster 47 as the adjustment base and hub body move apart or away from each other. The expansion of the space adjuster causes it to abut and be forced upon the wall interior surface 19 and lever hub 51. This action also causes the rod to be forced toward the interior of the cold-room, thereby forcing the rod guide pins 49 against the rod holder and into a locked position. The steps 78 of the hub body camming surfaces 77 lock against the steps 66 of the adjustment base camming surfaces 65 to prevent the backing off or backwards rotation of the hub body 57 relative to the underlying adjustment base 56. The lever is then rotated back (clockwise) to its "locked" position and a drill is utilized to form a complete screw mounting hole in one of the three pre-formed drill points and through the underlying adjustment base 56. The mounting screw 84 is then threaded into the newly formed mounting holes of the hub body and adjustment base to prevent rotational movement therebetween.

Now, if a person is accidentally locked within the cold room that person may easily open the door by rotating the lever 90 degrees counter-clockwise, thereby returning the pinned coupling rod 35 to its "unlocked" position with the guide pin 49 positioned in alignment with the pin portions 42 of the central passageway 34. The pinned coupling rod 35 may then be extracted completely from the exterior strike assembly 16, thereby causing the exterior strike assembly to drop off the wall through little, if any, outward force upon the door even with the handle 11 in its locked position, i.e., with the handle locking bolt residing within the lockable strike bolt opening 26 and contacting the housing top edge 27 of the bolt opening. With the lockable strike 10 unmounted from the wall, the locking handle 11 can not prevent the door from opening and the person may exit the cold-room through the open door.

It should be understood that the camming surfaces 65 and 77 may also be designated a cam follower as one surface rides upon the camming surface. It is not material which camming surface is designed or designated to be the cam or cam follower, as the relative positions of the adjustment base and hub body may easily be switched with some modifications thereto, such as the position of the adjustment base detent 70. Also, it should be understood that one of the camming surfaces 65 or 77 need not be a complete ramp or extended surface, as such would also work if one of the camming surfaces were simply a protrusion configured to ride upon and engage the step of an opposing camming surface.

It should be understood that other types of devices may be utilized to lock the relative position of the hub body to the adjustment base, such as detents, pawls, adhesives, set pins, or the like.

It should be understood that the space adjuster allows for a tighter fit of the lockable strike when mounted to the wall. Also, a person may release the lock strike with only a quarter turn of the lever, i.e., a 90 degree turn releases the lockable strike, rather than having to manually unscrew the handle through multiple rotations as described in the prior art. Lastly, the elongated handle enables one to leverage the rotation of the interior release assembly so that a weaker person may still release the lockage strike after it has been tightened by a stronger person.

It should be understood that the foregoing descriptions merely relate to exemplary, illustrative embodiments of the invention. Therefore, it should also be understood that various modifications may be made to exemplary embodiments described herein that are within the scope of the invention, which will be recognized by one of ordinary skill in the art in light of the disclosure herein. Furthermore, various elements of the described exemplary embodiments of the invention may be known in the art or recognized by one of ordinary skill in the art based on the disclosure herein.

The invention claimed is:

1. A lockable strike for walk-in cold rooms having a locking handle with a moveable bolt, comprising, an exterior strike assembly having a housing configured to receive the bolt of the locking handle, and a rod receiver coupled to said housing, and an interior strike assembly having a rod having a first end configured to rotatably mate with said rod receiver, handle coupled to a second end of said rod, and a space adjuster coupled to said rod between said first and second ends, said space adjuster including an adjustment base with at least one camming surface inclining in a rotary direction about an adjustment base central rod passageway and having at least one radially extending step with a radially extending ledge, said space adjuster also including a hub body with at least one camming surface inclining in a rotary direction about a hub body central rod passageway and having at least one radially extending step with a radially extending ledge configured to mate with said adjustment base camming surface radially extending step, said adjustment base camming surface and said hub body camming surface being configured to mate so as to expand and contract the size of said space adjuster in a longitudinal direction along said rod through rotary movement of said hub body relative to said adjustment base.

2. The lockable strike of claim 1 wherein said adjustment base camming surface has a plurality of radially extending steps having radially extending ledges, and wherein said hub body camming surface has a plurality of radially extending step having radially extending ledges configured to mate with said adjustment base camming surface plurality of radially extending steps.

3. The lockable strike of claim 1 further comprising a lock for locking the relative position of said adjustment base relative to said hub body.

4. The lockable strike of claim 3 wherein said lock is a set screw extending through said hub body and contacting said adjustment base.

5. The lockable strike of claim 1 wherein said adjustment base is configured to nest within said hub body.

6. A lock strike comprising, an exterior strike assembly adapted to engage a corresponding locking handle, said exterior strike assembly having a rod holder configured to releasably hold a rod, and an interior strike assembly having a rod configured to be releasably held within said rod holder, a handle coupled to said rod, and a space adjuster coupled to said rod in a position to abut said handle, said space adjuster including a first portion with an arcuate stepped camming surface and a second portion with a cam follower having an arcuate stepped camming following surface configured to mate with said first portion arcuate stepped camming surface to vary the size of said space adjuster through relative rotation between said first portion and said second portion.

7. The lockable strike of claim 6 wherein said first portion arcuate stepped camming surface has a plurality of steps, and wherein said second portion arcuate stepped cam following surface has a plurality of steps configured to mate with said first portion arcuate stepped camming surface plurality of steps.

8. The lockable strike of claim 6 further comprising a lock for the relative position of said first portion relative to said second portion.

9. The lockable strike of claim 8 wherein said lock is a set screw extending through said second portion and contacting said first portion.

10. The lockable strike of claim 6 wherein said first portion is configured to nest within said second portion.

* * * * *